United States Patent [19]

Salmon et al.

[11] Patent Number: 4,522,285

[45] Date of Patent: Jun. 11, 1985

[54] HYDRAULIC TIE-DOWN FOR ELEVATORS

[75] Inventors: John K. Salmon, South Windsor; Irving A. Hiller, Gales Ferry, both of Conn.

[73] Assignee: Otis Elevator Company, Farmington, Conn.

[21] Appl. No.: 543,703

[22] Filed: Oct. 20, 1983

[51] Int. Cl.[3] ..... B22B 11/04

[52] U.S. Cl. ..... 187/22; 187/1 A; 254/277; 104/196; 188/280

[58] Field of Search ..... 187/20, 22, 26, 1 A, 187/68, 70, 94; 254/277; 104/178, 196; 188/280, 300, 313, 314; 137/498

[56] References Cited

U.S. PATENT DOCUMENTS

| | | | |
|---|---|---|---|
| 1,132,761 | 3/1915 | Boening | 187/22 |
| 1,864,588 | 6/1932 | Dunlop | 187/70 |
| 4,236,695 | 12/1980 | Morrison | 254/277 |
| 4,395,178 | 7/1983 | MacDonell et al. | 254/277 X |
| 4,470,355 | 9/1984 | Kunczynski | 187/22 X |
| 4,480,729 | 11/1984 | Porter | 137/498 X |

FOREIGN PATENT DOCUMENTS

| | | | |
|---|---|---|---|
| 0880311 | 10/1961 | United Kingdom | 187/22 |

*Primary Examiner*—Joseph J. Rolla
*Assistant Examiner*—Nils E. Pedersen
*Attorney, Agent, or Firm*—Robert E. Greenstien

[57] ABSTRACT

A compensating rope sheave tie-down uses a hydraulic control system comprising various valves to control sheave motion. The sheave is permitted by the control system to move up and down slightly at slow rates, but is held in place if a high rate occurs. The control also permits the sheave to drop down to apply tension to the compensating rope.

4 Claims, 1 Drawing Figure

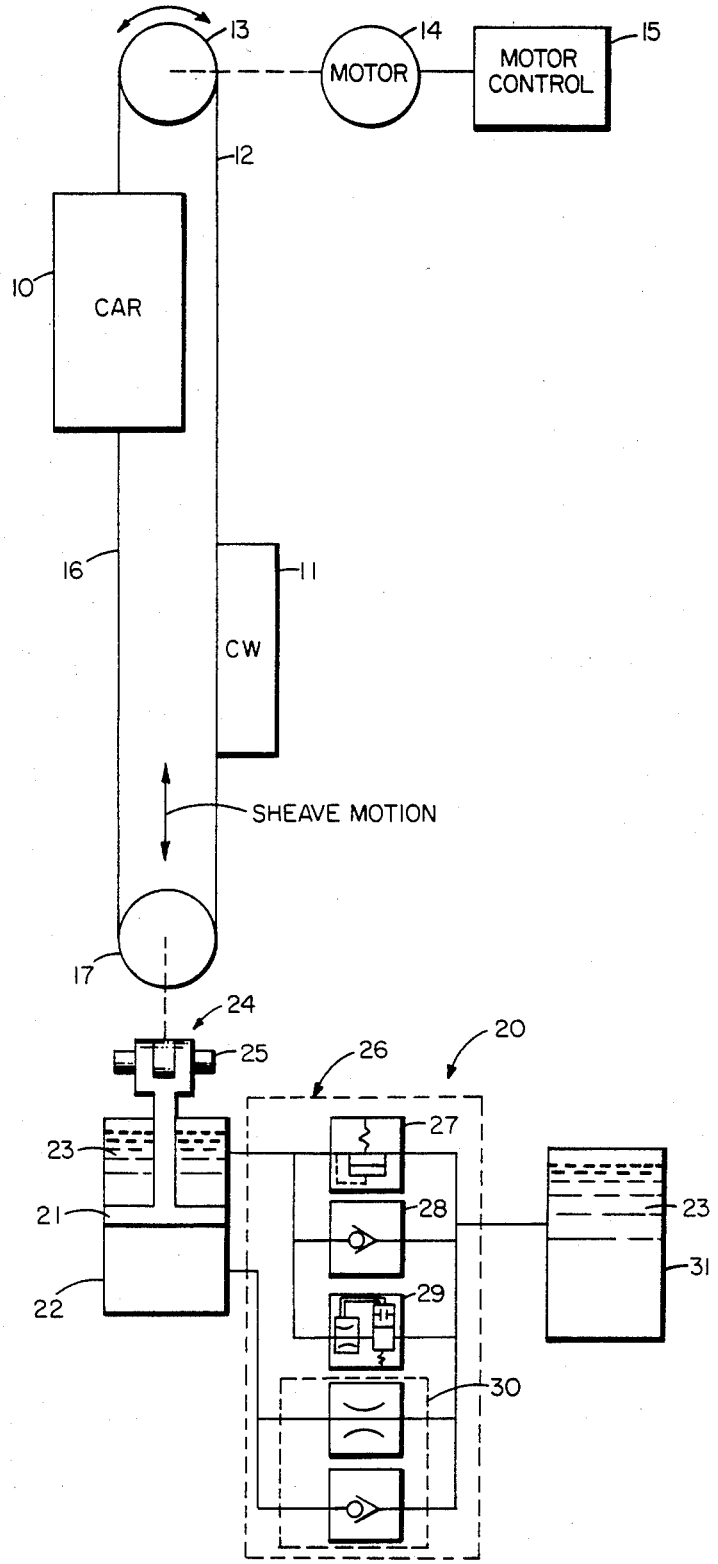
13
14
MOTOR
MOTOR CONTROL
15
12
10
CAR
16
11
CW
SHEAVE MOTION
17
24
25
26
20
27
23
28
23
21
31
22
29
30

HYDRAULIC TIE-DOWN FOR ELEVATORS

DESCRIPTION

1. Technical Field

This invention relates to elevators, and, in particular, tie-downs, devices used in elevators for controlling the motion of the compensating sheave.

2. Background Art

It is not uncommon for many elevators to have a compensating rope that extends from the bottom of the elevator car to the bottom of the counterweight, passing between the two around a sheave, known as the compensating sheave. In prior art systems, this sheave is usually connected to a control device that consists of a safety. If the compensating sheave is suddenly raised at an excessive rate (e.g., due to a test operation on the buffer or safety), the sheave is locked or held in place, stabilizing the motion of the counterweight due to the abrupt deceleration forces that are applied to the counterweight at that time. The typical buffer tie-down consists of a rack and pawl type monomass safety. These allow the sheave to move free, except when high acceleration forces are encountered. This type of tie-down is subject to climatic variations in the components and the compensating rope. They are principally intended to control the motion of the compensating sheave under extreme acceleration conditions, not normal operation. Sometimes they can be noisy and can produce enough vibrations to create an inferior ride.

DISCLOSURE OF INVENTION

An object of the present invention is to provide a nonmechanical, compensating sheave restraint system—tie-down—that not only restrains the sheave under high acceleration conditions during tests and emergency stops, but also controls its motion during normal operation to avoid vibration and noise.

Another object is to provide a tie-down that is immune to climatically produced changes in the dimension of the rope.

According to the present invention, the compensating sheave is held in place by a hydraulic device that accommodates fluid at rates that are determined by the motion characteristics of the sheave. This is achieved by an arrangement of valves. When the compensating sheave is pulled up very rapidly—as it would be in an emergency stop or test operation—flow from the hydraulic device to the reservoir is blocked, holding the compensating sheave in place and applying the restraining force to the counterweight. If the sheave motion is below a preset threshold level, a certain flow rate is allowed into the reservoir, allowing the compensating sheave to rise slowly, thereby providing a controlled resisting force, producing damping action. Flow to the reservoir is also permitted when there is an exceptionally high pressure condition in the hydraulic damping device, which can occur in a number of situations; for instance, if the ropes are tangled. This allows the compensating sheave to move upward, without developing excessive rope tension, permitting continued motion of the car despite the immediate problem (the tangle) that resists further movement of the rope around the sheave. The sheave is allowed to drop down at a controlled rate by controlling flow to the reservoir during a down stroke.

Among the features of the present invention are these: it provides control over the motion of the compensating rope in such a fashion that the traditional problems associated with holding the counterweight in place during emergency stop and test operation are eliminated; the tie-down made possible by the present invention automatically compensates for any changes in the dimensions of the compensating rope; and the tie-down always leaves a satisfactory tension on the compensating rope.

BRIEF DESCRIPTION OF THE DRAWING

The drawing, a diagrammatic view of an elevator system, includes a schematic illustration of a hydraulic tie-down embodying the present invention, it being connected to a compensating sheave that controls the tension on a compensating rope that is attached to the elevator car and the counterweight.

BEST MODE FOR CARRYING OUT THE INVENTION

The elevator system that is shown has an elevator car 10 and a counterweight 11, which are part of a "traction" elevator system that has a rope 12 which extends from the top of the car over a drive sheave 13 to the top of the counterweight. The drive sheave is connected to a motor 14 whose operation is controlled by a motor control 15. The foregoing are typical parts of a traction elevator. A compensating rope 16, however, extends from the bottom of the elevator car around a compensating rope sheave 17, then to the bottom of the counterweight. The compensating rope serves two functions: to compensate for the changes in the motor torque required due to changes in the length of the hoist rope from the drive sheave to the top of the counterweight; to provide support to the car and counterweight if the car is abruptly stopped, as it would be, for example, in an emergency stop when the safety is operated or during a buffer test. The compensating rope is intended to hold the counterweight in place if it is moving up. The compensating sheave must apply downward force on the compensating rope, and in prior art systems this is done by a tie-down. Tie-downs, as mentioned before, typically consist (in the prior art) of a mechanical arrangement using ratchets and pawls that engage when the compensating sheave is thrust upward, holding it in place and pulling down on the counterweight. Some upward movement is allowed by prior art tie-downs until a tripping acceleration rate is encountered as the sheave ascends. But, in the elevator system shown in the drawing, the differences over the prior art are quite plain. The tie-down arrangement there consists of a hydraulic system 20 connected to the sheave. The system contains a piston 21 which is housed in an hydraulic cylinder 22 containing fluid 23. The mechanical connection between the piston and the compensating sheave is through a linkage 24 that (preferably) includes a shear pin 25. If for one reason or another there is an absolute or catastrophic jam and the sheave motion exceeds the available stroke of tie-down, the mechanical connection between the hydraulic tie-down and the compensating sheave will be broken and the compensating sheave will be allowed to move upward when the shear pin breaks. This may happen if there is a jam or bind in the rope.

The hydraulic piston simply moves up and down in the cylinder, applying force to the compensating sheave, and in turn the compensating rope keeping it in tension. The tie-down includes a valve arrangement 26 which consists of a relief valve 27, a check valve 28, a flow fuse 29, and a line throttle valve 30; these control fluid flow between the cylinder containing the piston and a fluid reservoir 31 which is arranged to provide a positive hydraulic head to the system. According to the present invention, and as accomplished by this hydraulic arrangement embodying it, the compensating sheave is allowed to move at different vertical rates under different conditions, those rates depending basically upon the pressure applied to the piston, which is, of course, related to the force that the compensating rope applies to the compensating sheave, which is related to the motion of the car and counterweight.

Assume that the car is abruptly brought to a stop while the counterweight is moving up. Under this condition it is desired to apply downward force through the compensating sheave to the compensating rope to help stop the counterweight's ascent, otherwise it might continue to move, perhaps causing a loss in traction on the drive sheave, which, if it happens, can deteriorate the stopping performance. As the counterweight moves up, an upward force is applied on the piston, and this creates fluid pressure in the upper portion of the cylinder and flow through the flow fuse. When that flow exceeds the flow fuse's setting, it shuts off, and pressure then builds rapidly in the cylinder. This maintains the tension on the counterweight that decelerates it. If, however, the pressure exceeds a certain level (P1), the relief valve will operate to allow the fluid to flow into the reservoir. Then the compensating sheave can move upward while maintaining a controlled load on the compensating rope. This should not occur during emergency stop, of course. But, this condition might occur if there is a bind of some sort or jam between the rope and sheave. For example, it might happen if there is a knot or a loose strand on the compensating rope. This would exert, even while the car is moving, a very strong upward pull on the compensating sheave. When this happens, the sheave should move upward slightly to prevent rapid deceleration of the car. The relief valve makes this possible.

During normal conditions, however, there is, of course, slight oscillating motion by the compensating rope, due to its length variations (function of car position and load) and system vibrations. Thus, as the car moves up and down in the elevator shaft, the compensating sheave will want to move up and down slightly about a null point (at rest position). Yet, adequate tension must be maintained all the time on the compensating rope to minimize sway and also maintain an adequate rope tension in case an emergency stop occurs, which requires holding the counterweight in place. This operation is attained with the flow fuse. The flow fuse allows a reasonable amount of flow to the reservoir at a slow rate. If, however, the flow should suddenly become very high (as it would be in an emergency stop situation), the flow fuse blocks the flow, holding the compensating sheave in place, thereby restraining the counterweight.

The check valve allows fluid to flow back from the reservoir when the piston moves downward, which it would do after an emergency stop situation, or during normal operation when it moves up and down slightly. Together the relief valve and the flow fuse thus provide a special type of operation with respect to the motion of the compensating sheave. The flow fuse allows the sheave to move up and down slightly, but blocks its motion at a rapid rate to provide sufficient tie-down force on the counterweight in emergency situations. The relief valve, on the other hand, allows fluid flow to occur when there is an extremely high pressure which could occur if there was a bind of some sort in the system under which conditions, as it was mentioned before, it is desired to allow the compensating sheave to move upward so as to allow the car to continue to move. The shut-off level on the flow fuse must be lower than the relief level on the relief valve—because the flow fuse should block flow to the reservoir only whenever there is an emergency stop. The relief valve serves to limit the rope tensions that may develop thereafter.

The tie-down not only provides damping as the compensating sheave moves up. Under a different set of circumstances the tie-down also provides damping as the piston moves down, and this is accomplished by means of the line throttle valve. This valve allows controlled flow from the bottom of the cylinder (the portion below the piston) into the reservoir. Such motion occurs as the compensating sheave moves down, which it does if there are slight oscillations (vertical up and down movement) due to variations in the rope length or vibrations as the car is moving, or the ropes are swaying. Thus, the line throttle valve and the flow fuse together provide damping action that results in extremely smooth rope motion around the compensating sheave. The line throttle valve though controlling fluid flow from the bottom of this cylinder to the reservoir for the purposes of providing damping to the compensating sheave motion also allows unrestricted flow back from the reservoir to the bottom of the cylinder when the compensating sheave moves upward. The purpose for this being to assure that the cylinder is always filled with fluid. Thus, when the piston is moved abruptly upward (for example, during an emergency car stop or when there is rope bind), fluid flows from the reservoir to the bottom of the piston. The piston is thereby ready (set, so to speak) to provide damping on a down stroke.

A feature of the present invention is that all constituent parts of the hydraulic control apparatus (the relief valve, check valve, flow fuse, and line throttle valve, and reservoir) can be conveniently mounted in a housing that is a manifold around the hydraulic cylinder. In other words, an entire hydraulic tie-down, the piston and cylinder and the valving and reservoir providing these functions can be an integral or single unit that is located very conveniently below the compensating sheave. A particular attraction, in fact, is that this forms a sealed system, one that requires no maintenance of any kind. It must not go unnoticed that elevator system tests during emergency conditions (for example, safety operation or buffer tests and terminal slowdown tests) lead to operation of the compensating sheave tie-down, and in prior art systems this would cause a mechanical engagement to occur that has to be mechanically reset by a service technician. The technician would have to go down to the pit and reset the safety. This is not required in a tie-down according to the present invention, for it can be repeatedly operated, automatically returning to the required position at which there is satisfactory tension on the compensating rope and at which it is "armed and ready" to provide adequate tie-down force for emergency stops and also allow the compensating sheave to move upward if there is a bind or knot in the line. The invention thus provides a significant improvement over prior art tie-downs in many ways.

Of course, variations and modifications of the present invention may be obvious to one skilled in the art from the foregoing, without departing from the true scope and spirit of the invention.

We claim:

1. An elevator comprising:

a motor drive;

a car;

a counterweight;

a drive rope connecting the car, counterweight, and motor drive for propelling the car and counterweight generally vertically;

a second rope extending from the bottom of the car to the bottom of the counterweight;

a sheave that is located below the car and which guides the second rope as the car and counterweight move;

said elevator characterized in that it includes a hydraulic control for controlling the vertical movement of the sheave that comprises:

a piston connected to the sheave;

a cylinder in which said piston moves vertically within fluid that is contained in the cylinder;

a reservoir for the fluid;

a valve control that controls fluid flow between the cylinder and the reservoir as the piston moves in response to the sheave's movement and comprises first valve means for allowing a maximum fluid flow rate from the cylinder to the reservoir during a piston upstroke and for stopping said flow in response to maximum positive rate of change in the fluid flow from the cylinder to the reservoir during a piston upstroke.

2. An elevator as described by claim 1, characterized in that said valve control comprises:

second valve means for allowing fluid flow from the cylinder to the reservoir in response to a certain pressure level being reached in the cylinder during a piston upstroke.

3. An elevator described in claim 2, characterized in that said valve control comprises:

third valve means for allowing fluid flow at a certain rate to the cylinder from the reservoir during a piston upstroke.

4. An elevator as described in claim 2, characterized in that said valve control comprises:

fourth valve means for allowing fluid flow from the reservoir to the cylinder during a piston downstroke at a certain rate.

* * * * *